US006564790B2

(12) United States Patent
Graham

(10) Patent No.: US 6,564,790 B2
(45) Date of Patent: May 20, 2003

(54) BOW REST

(76) Inventor: Richard C. Graham, 1879 County Rd. 10, Ancram, NY (US) 12502

( * ) Notice: Subject to any disclaimer, the term of this patent is extended or adjusted under 35 U.S.C. 154(b) by 0 days.

(21) Appl. No.: 09/866,952

(22) Filed: May 29, 2001

(65) Prior Publication Data

US 2002/0179078 A1 Dec. 5, 2002

(51) Int. Cl.[7] ..... F41B 5/14; A45F 3/44

(52) U.S. Cl. ..... 124/86; 248/125.1; 248/156; 248/176.3; 248/688

(58) Field of Search ..... 124/86, 88; 248/125.1, 248/156, 176.3, 688

(56) References Cited

U.S. PATENT DOCUMENTS

| | | | | | |
|---|---|---|---|---|---|
| 1,073,874 | A | * | 9/1913 | Smith | |
| 1,366,872 | A | * | 1/1921 | Cantleberry | |
| 1,975,303 | A | * | 10/1934 | Walker et al. | |
| 3,108,828 | A | * | 10/1963 | Kus | |
| 3,256,872 | A | | 6/1966 | Koser | |
| 3,880,136 | A | | 4/1975 | Leidy | 124/30 |
| 4,290,407 | A | | 9/1981 | Damron | 124/41 |
| 4,474,296 | A | * | 10/1984 | Hartman | |
| 4,674,472 | A | | 6/1987 | Reis | 124/89 |
| 4,729,363 | A | | 3/1988 | Skyba | 124/23 |
| 4,748,964 | A | | 6/1988 | Troncoso | 124/41 |
| D355,694 | S | | 2/1995 | Stafford | D22/107 |
| 5,482,241 | A | * | 1/1996 | Oglesby | |
| 5,547,162 | A | | 8/1996 | Sobolewski | 248/688 |
| 5,630,568 | A | | 5/1997 | Lubrecht | 248/217.4 |
| 5,697,537 | A | | 12/1997 | Bowlsby | 224/270 |
| 6,012,439 | A | * | 1/2000 | Woodruff | |
| 6,021,768 | A | | 2/2000 | Pomaville | 124/1 |

* cited by examiner

*Primary Examiner*—John A. Ricci
(74) *Attorney, Agent, or Firm*—Pennie & Edmonds LLP

(57) ABSTRACT

The present invention relates to bow rests which are portable, lightweight and easily adjustable. The bow rests of the present invention generally comprise a plate wherein an opening is formed in a first end section of the plate and the second end section of the plate is bent such that an angle is formed between the plane of the first end section and the plane formed by the second end section. A mount, which is configured to be fixed to a bow is pivotally attached to the second end section. The opening is adapted and configured such that a shaft such as, for example, walking/wading sticks, staffs, canes and tree limbs can be inserted through the opening and the height of the bow rest above a surface can be quickly and easily adjusted. The bow rest is adapted and configured such that the weight of a bow is transferred to the bow rest and shaft thereby improving the accuracy of a sportsman shooting the bow.

31 Claims, 9 Drawing Sheets

BOW REST

TECHNICAL FIELD

The present invention relates to versatile bow rests and more specifically to bow rests that are both compact and readily available. Additionally, the present invention relates to a method for improving the accuracy of a sportsman.

BACKGROUND OF THE INVENTION

It is well known that a shooter's accuracy is increased through the use of a gun rest. However, the use of bow rests to improve the accuracy of arrows fired by sportsmen have generally been overlooked.

Many devices have been fabricated to improve the accuracy of a sportsman using a bow such as, for example, stabilizers, sights and chin rests but none of these devices support the weight of the bow.

U.S. Pat. No. 4,674,472 describes a bow hip rest which is designed to transfer the weight of the bow from an archer's arm to his hip. This bow rest consists of a rod with a hip rest attached to one end while the other end is configured to be mounted on the hand grip of a bow. The rod extends rearward before being angled downwards such that it extends behind the bowstring. This bow rest can be adjusted to accommodate archers with different arm lengths by utilization of a two-part, externally threaded rod and an internally threaded coupling, or custom fitted to an individual.

This bow rest can be manufactured to be lightweight but it is not readily adjustable to accommodate different shooting postures that may be necessitated by terrain or location such as, for example shooting uphill, downhill or from a tree stand. Additionally, the design of this bow rest results in the hip rest extending behind the bowstring. Many archers carry their bows at their side while walking and the rod extending behind the bowstring would make such a carrying posture uncomfortable.

Thus there exists a need for a compact, portable, lightweight bow rest that is quickly and easily adjusted over a wide range of heights such that a sportsman can take advantage of the most comfortable and convenient posture as dictated by the terrain of hunting situation.

SUMMARY OF THE INVENTION

The present invention relates to bow rests which are compact, lightweight and readily height adjustable. This ease of adjustment allows a sportsman to quickly adapt the rest to the body posture dictated by the terrain and situation.

A bow rest in accordance with one embodiment of the present invention comprises a plate. A first end section of the plate has an opening which is sized such that a shaft may be inserted into the opening. A second end section of the plate is angled from the plane formed by the first end section of the plate and configured to be pivotally attached to a mount on a bow. Upon insertion of a shaft into the opening, with the angled end being on the bottom side of the bow rest, a sportsman can adjust the bow rest to the proper height on the shaft. Any variety of shafts may be employed such as, for example, walking/wading sticks, staffs, canes and tree limbs. The weight of the bow will serve to tightly hold the bow rest in position on the shaft thereby removing the weight of the bow from the sportsman as well as providing a steady base to improve accuracy.

Embodiments of the present invention have teeth formed into the opening or the opening covered by flexible gripping aids to aid in gripping the shaft to act as a stable support for the bow. The flexible gripping aids further serve to silence the bow rests.

A bow rest in accordance with another embodiment of the present invention comprises a plate. A first end section of the plate is adapted and configured to be inserted into a preformed slit on a shaft. A support arm is permanently attached to the plate and extends downwards from the plane formed by the plate with a terminal end directed towards the first end. The support arm is adapted and configured to be inserted through the preformed slit. When the weight of a bow is applied to the bow rest the first end and terminal end serve to hold the bow rest at a desired height on the shaft. A second end section of the plate is angled from the plane formed by the plate and configured to be pivotally attached to a mount on a bow. Upon insertion of the bow rest into the preformed slit, with the angled end being on the bottom side of the bow rest, a sportsman can adjust the bow rest to the proper height on the shaft.

The bow rests of the present invention may be constructed from any material displaying the necessary rigidity to support the weight of a bow. Such material, for example, may be steel, aluminum, other metallic materials, composite materials, polymeric materials, wood or glass.

The bow rests may be fitted into the receptacle of a mounting bracket, which may either be used on a flat surface or attached to a surface by means of pressure plates and a tightener, to further stabilize the bow rest and thereby increase the accuracy of the sportsman using the bow rests.

DETAILED DESCRIPTION OF THE INVENTION

Figure 1:
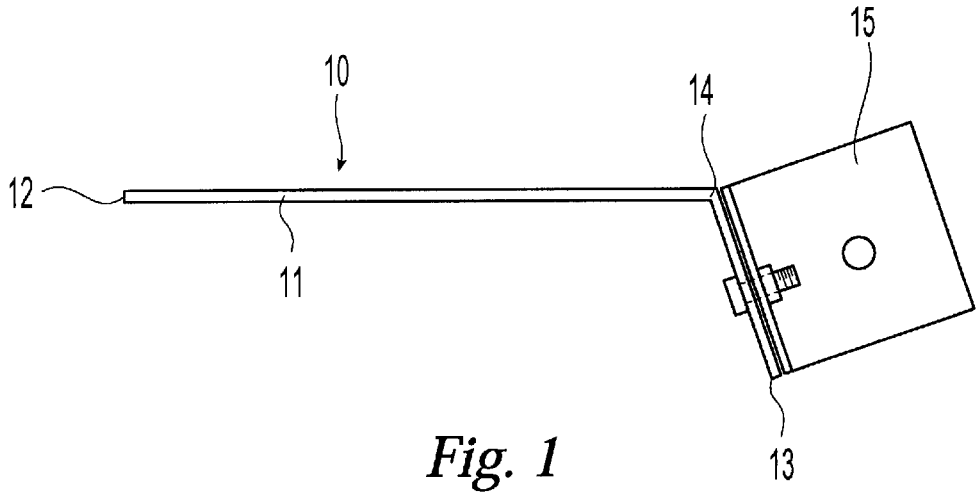
FIG. 1 is an elevation (side) view of a bow rest according to one embodiment of the present invention.

FIG. 1 illustrates a side view of bow rest 10. Bow rest 10 comprises a plate 11 having a first end section 12, a second end section 13 and an intermediate section 14. Plate 11 is bent at intermediate section 14 such that an angle from about 90 to about 150 degrees is formed between the plane of the first end section 12 and the plane of the second end section 13. Second end section 13 is configured to be pivotally attached to mount 15 which is configured to be fixed to a bow.

Plate 11 may be formed straight and bent or preformed with an angle.

While plate 11 and mount 15 are illustrated as being pivotally attached with a bolt and lock-nut combination it would be readily apparent to one skilled in the art that other pivotally attaching fasteners or devices may be used. Additionally, while mount 15 is illustrated as being configured to be fixed to the stabilizer hole of a bow it is understood that mount 15 may be fixed to a bow by other attaching arrangements.

Figure 2:
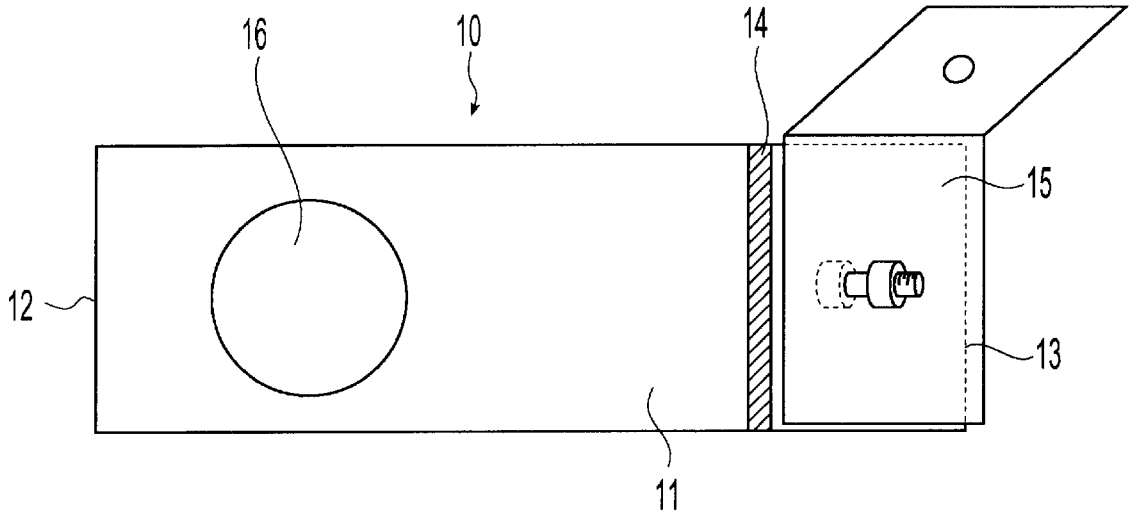
FIG. 2 is a perspective view of the bow rest of FIG. 1.

FIG. 2 illustrates opening 16 formed in plate 11 between intermediate section 14 and first end section 12. Opening 16 is configured in shape and size such that a shaft may be inserted into opening 16.

While opening 16 is illustrated as being generally circular in shape, it may be appreciated that opening 16 may be of any shape and size desired such that a shaft may be inserted into opening 16. Additionally, it is understood that plate 11 may be constructed of any material displaying the necessary strength and rigidity to support the weight of a bow such as, for example, steel, aluminum, other metallic materials, composite materials, polymeric materials, wood or glass. Further, it is understood that plate 11 may be pivotally attached to mount 15 by any variety of devices and fasteners such as, for example, rivets or bolt and lock-nut combinations. Finally, it is understood that mount 15 may be of any configuration that can be fixed to a bow. Preferably, mount 15 is generally L-shaped and configured such that it may be fixed to a stabilizer hole on a bow with a bolt.

Figure 3:
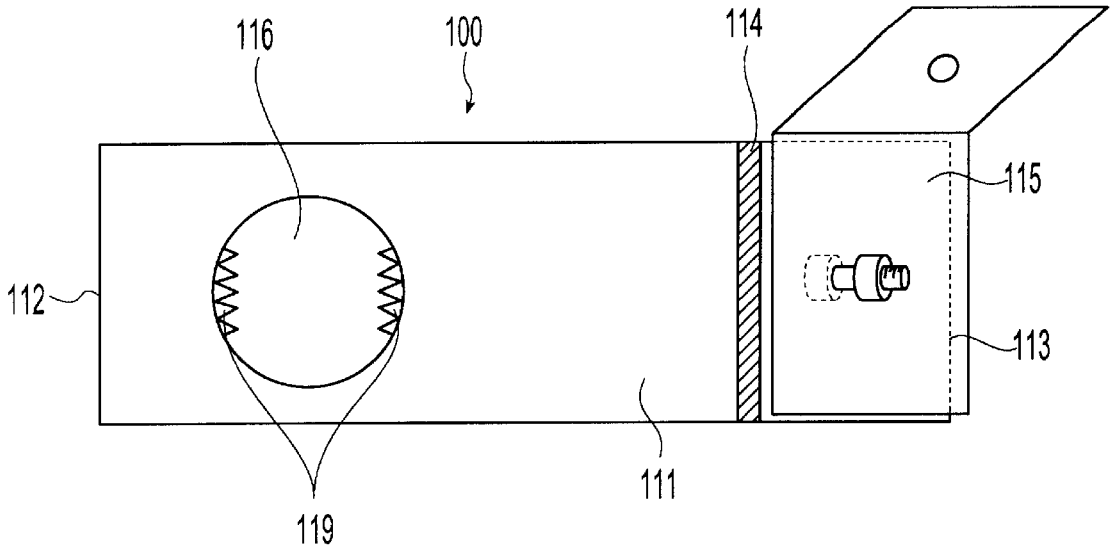
FIG. 3 is a perspective view of a bow rest, which incorporates teeth, according to another embodiment of the present invention.

FIG. 3 illustrates a top view of bow rest 100. Bow rest 100 comprises a plate 111 having a first end section 112, a second end section 113 and an intermediate section 114. Plate 111 is bent at intermediate section 114 such that an angle from about 90 to about 150 degrees is formed between the plane of the first end section 112 and the plane of the second end section 113. Second end section 113 is configured to be pivotally attached to mount 115 which is configured to be fixed to a bow. Opening 116 is formed in plate 111 between intermediate section 114 and first end section 112. Opening 116 is configured in shape and size such that a shaft may be inserted into opening 116. Teeth 119 are located around the perimeter of opening 116 such that teeth 119 will aid in gripping a shaft inserted into opening 116.

While opening 116 is illustrated as being generally circular in shape, it may be appreciated that opening 116 may be of any shape and size desired such that a shaft may be inserted into opening 116. Additionally, it is understood that teeth 119 may be arranged around the perimeter of opening 116 in any configuration and size desired to improve the gripping of a shaft inserted into opening 116. Further, it is understood that plate 111 may be constructed of any material displaying the necessary strength and rigidity to support the weight of a bow such as, for example, steel, aluminum, other metallic materials, composite materials, polymeric materials, wood or glass. Further, it is understood that plate 111 may be pivotally attached to mount 115 by any variety of devices and fasteners such as, for example, rivets or bolt and lock-nut combinations. Finally, it is understood that mount 115 may be of any configuration that can be fixed to a bow. Preferably, mount 115 is generally L-shaped and configured such that it may be fixed to a stabilizer hole on a bow with a bolt.

Figure 4:
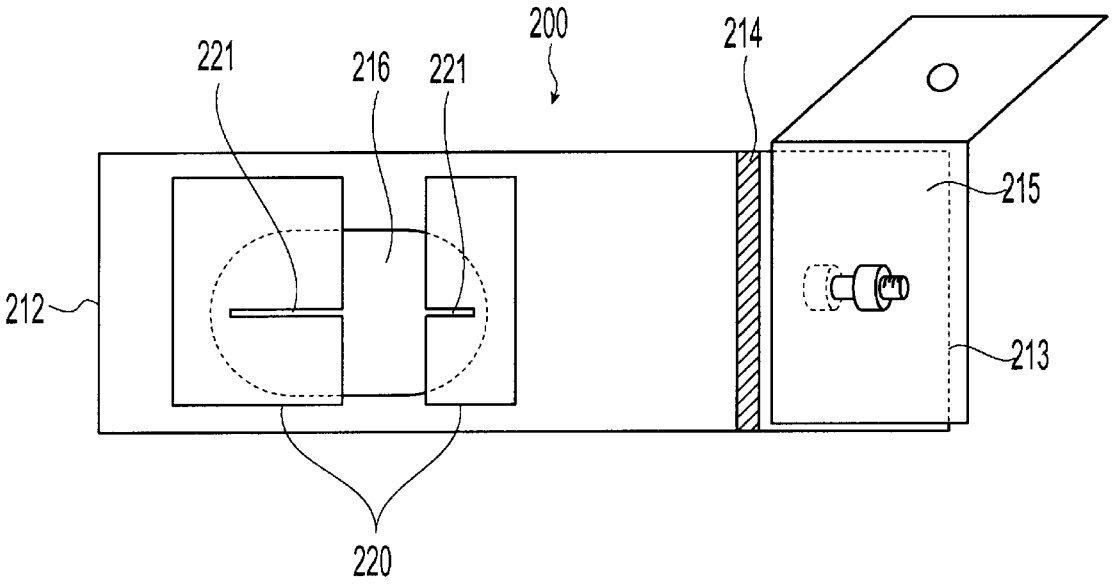
FIG. 4 is a perspective view of a bow rest which incorporates flexible gripping aids according to yet another embodiment of the present invention.

FIG. 4 illustrates a top view of bow rest 200. Bow rest 200 comprises a plate 211 having a first end section 212, a second end section 213 and an intermediate section 214. Plate 211 is bent at intermediate section 214 such that an angle from about 90 to about 150 degrees is formed between the plane of the first end section 212 and the plane of the second end section 213. Second end section 213 is configured to be pivotally attached to mount 215 which is configured to be fixed to a bow. Opening 216 is formed in plate 211 between intermediate section 214 and first end section 212. Opening 216 is configured in shape and size such that a shaft may be inserted into opening 216. Flexible gripping aids 220, which contain slits 221, are located such that a portion of opening 216 is covered. Flexible gripping aids 220 will aid in gripping a shaft inserted into opening 216 as well as serving as a silencer between bow rest 200 and a shaft inserted into opening 216.

While opening 216 is illustrated as being generally circular in shape, it may be appreciated that opening 216 may be of any shape and size desired such that a shaft may inserted into opening 216. Additionally, it is understood that flexible gripping aids 220, which contain slits 221, may be arranged around the perimeter of opening 216 in any configuration and size desired to improve the gripping of a shaft inserted into opening 216. Further, flexible gripping aids 220 may be constructed of any suitable material, although plastic materials are preferred. Further, it is understood that plate 211 may be constructed of any material displaying the necessary strength and rigidity to support the weight of a bow such as, for example, steel, aluminum, other metallic materials, composite materials, polymeric materials, wood or glass. Further, it is understood that plate 211 may be pivotally attached to mount 215 by any variety of devices and fasteners such as, for example, rivets or bolt and lock-nut combinations. Finally, it is understood that mount 215 may be of any configuration that can be fixed to a bow. Preferably, mount 215 is generally L-shaped and configured such that it may be fixed to a stabilizer hole on a bow with a bolt.

Figure 5:
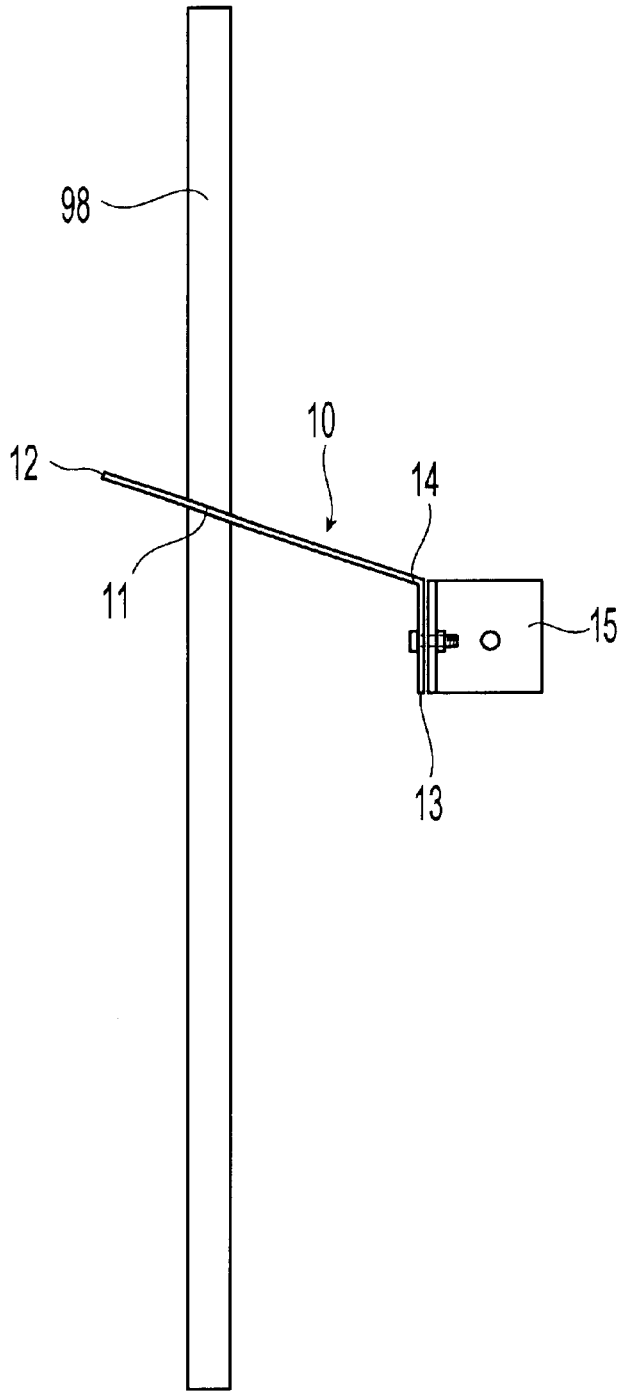
FIG. 5 is an elevation (side) view of the bow rest of FIG. 1 mounted on a k shaft.

FIG. 5 illustrates a side view of bow rest 10 slidably attached to shaft 98. Bow rest 10 comprises a plate 11 having a first end section 12, a second end section 13 and an intermediate section 14. Plate 11 is bent at intermediate section 14 such that an angle from about 90 to about 150 degrees is formed between the plane of the first end section 12 and the plane of the second end section 13. Second end section 13 is configured to be pivotally attached to mount 15 which is configured to be fixed to a bow.

Figure 6:
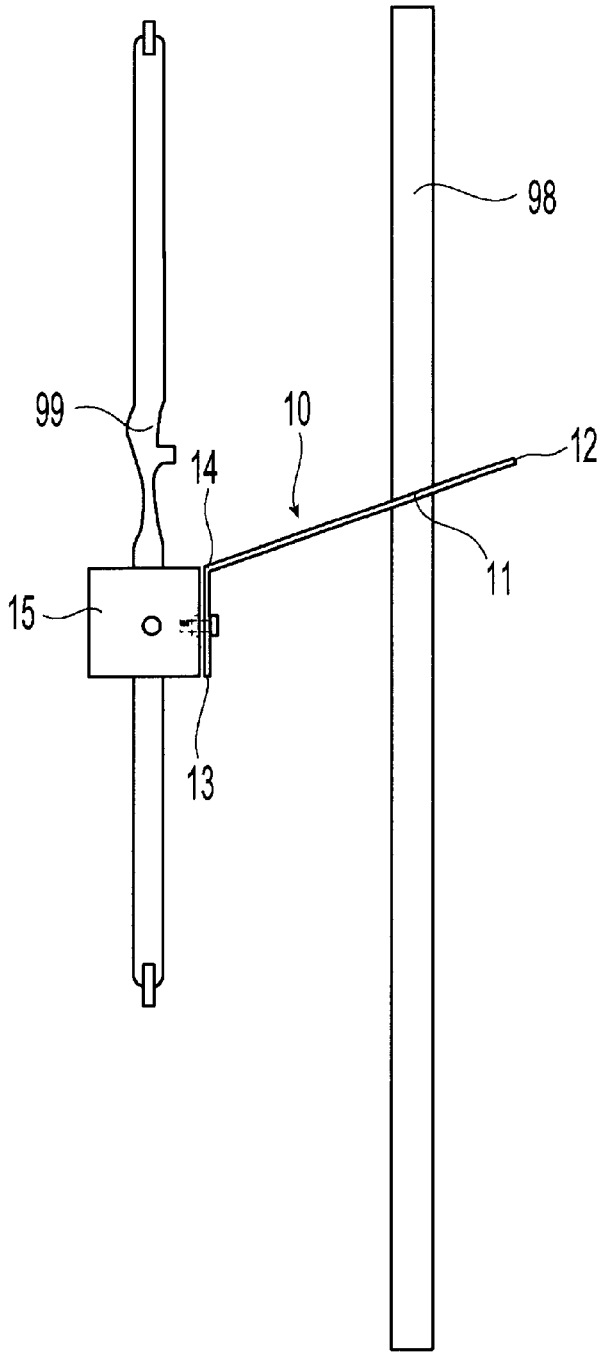
FIG. 6 is an elevation (side) view of the bow rest of FIG. 1 on a shaft and attached a bow.

FIG. 6 illustrates a side view of bow rest 10 slidably attached to a shaft 98 while supporting the weight of a bow 99 in order to improve the accuracy of a sportsman using bow rest 10. Bow rest 10 comprises a plate 11 having a first end section 12, a second end section 13 and an intermediate section 14. Plate 11 comprising first end section 12, second end section 13 and intermediate section 14 is pivotally attached to mount 15 with a bolt and lock-nut combination. Mount 15 is fixed to the stabilizer hole of bow 99 with a bolt. It is understood that the rapid and easy adjustment of bow rest 10 on shaft 98 would allow a sportsman to assume the most comfortable and convenient posture as dictated by the terrain or hunting situation.

Figure 7:
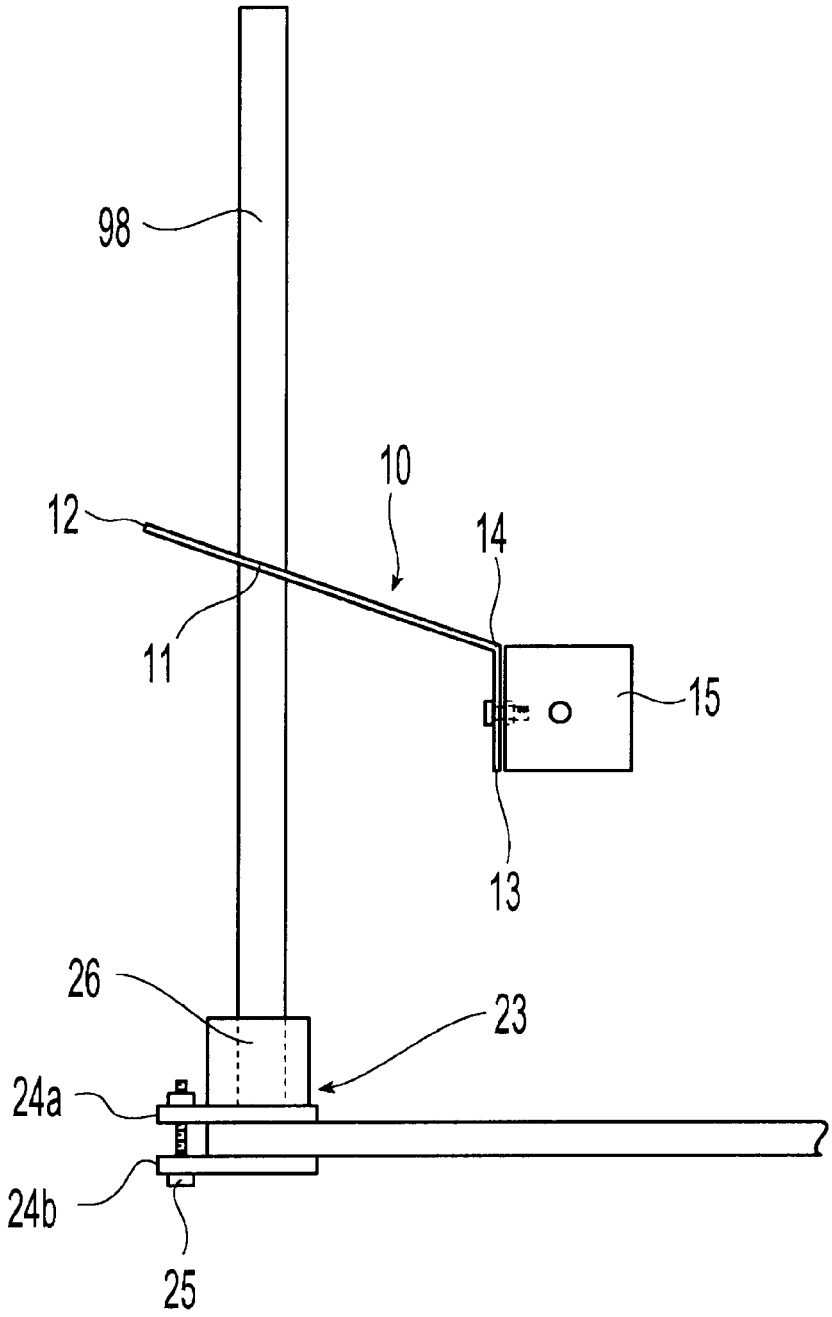
FIG. 7 is an elevation (side) view of the bow rest of FIG. 1 on a shaft where the shaft has been fixed to a surface.

FIG. 7 illustrates a side view of bow rest 10 slidably attached to shaft 98 wherein shaft 98 has been fixed to a surface. Bow rest 10 comprises a plate 11 having a first end section 12, a second end section 13 and a intermediate section 14. Plate 11 between second end section 13 and intermediate section 14 is bent such that an angle from about 90 to about 150 degrees is formed between the plane of the first end section 12 and the plane of the second end section 13. Second end section 13 is configured to be pivotally attached to mount 15 which is configured to be fixed to a bow.

Shaft 98 is attached to a surface by the use of mounting bracket 23. Mounting bracket 23 comprises two pressure plates 24*a* and 24*b*, tightener 25 and receptacle 26. Pressure plates 24*a* and 24*b* are slipped over the end of a surface such as, for example, a tree stand or porch floor and are tightened against the surface by use of tightener 25. Receptacle 26 is permanently attached to pressure plate 24*a* and forms a cylindrical cavity perpendicular to pressure plate 24*a* such that shaft 98 can be inserted into the cylindrical cavity. Tightener 25 is illustrated as a bolt and nut but it is understood that tightener 25 may take the form of any device which can fasten to a surface.

Alternatively, pressure plate 24*a* may be disconnected from pressure plate 24*b* and tightener 25 and used as a flat surface for receptacle 26, which may be used upon any surface not capable of fitting between pressure plates 24*a* and 24*b* such as, for example, the ground or the bed of a pick-up truck.

Figure 8:
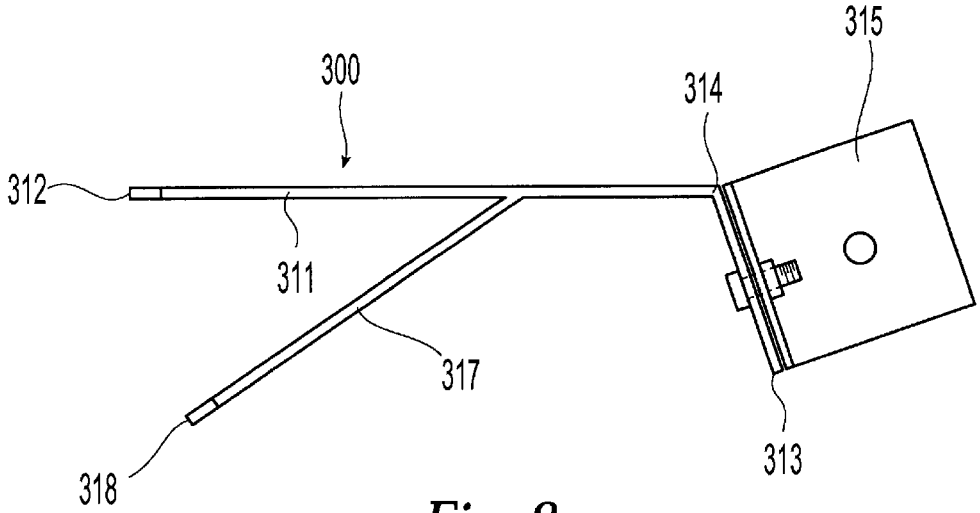
FIG. 8 is an elevation (side) view of a bow rest according to a further embodiment which is adapted and configured to be used with a shaft having a preformed slit.

FIG. 8 illustrates a side view of bow rest 300. Bow rest 300 comprises a plate 311 having a first end section 312, a support arm 317, which contains a terminal end 318, a second end section 313 and a intermediate section 314. Plate 311 is bent at intermediate section 314 such that an angle from about 90 to about 150 degrees is formed between the plane of the first end section 312 and the plane of the second end section 313. Second end section 313 is configured to be pivotally attached to mount 315 which is configured to be fixed to a bow.

While plate 311 and mount 315 are illustrated as being pivotally attached with a bolt and lock-nut combination it is understood that they may be pivotally attached by any variety of devices and fasteners. Additionally, while mount 315 is illustrated as being configured to be fixed to the stabilizer hole of a bow it is understood that mount 315 may be fixed to a bow with any variety of devices and fasteners.

Figure 9:
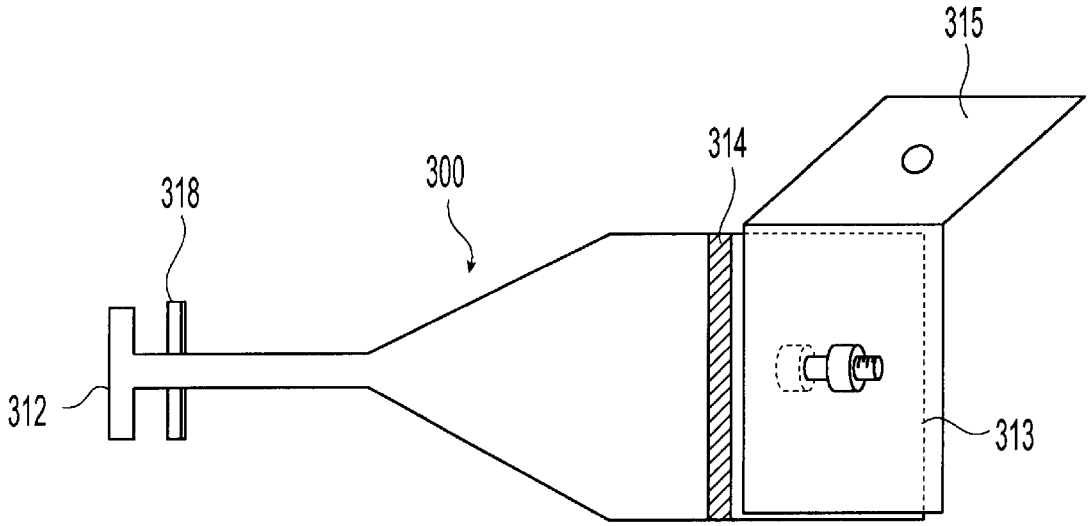
FIG. 9 is a perspective view of the bow rest of FIG. 8.
Figure 9A:
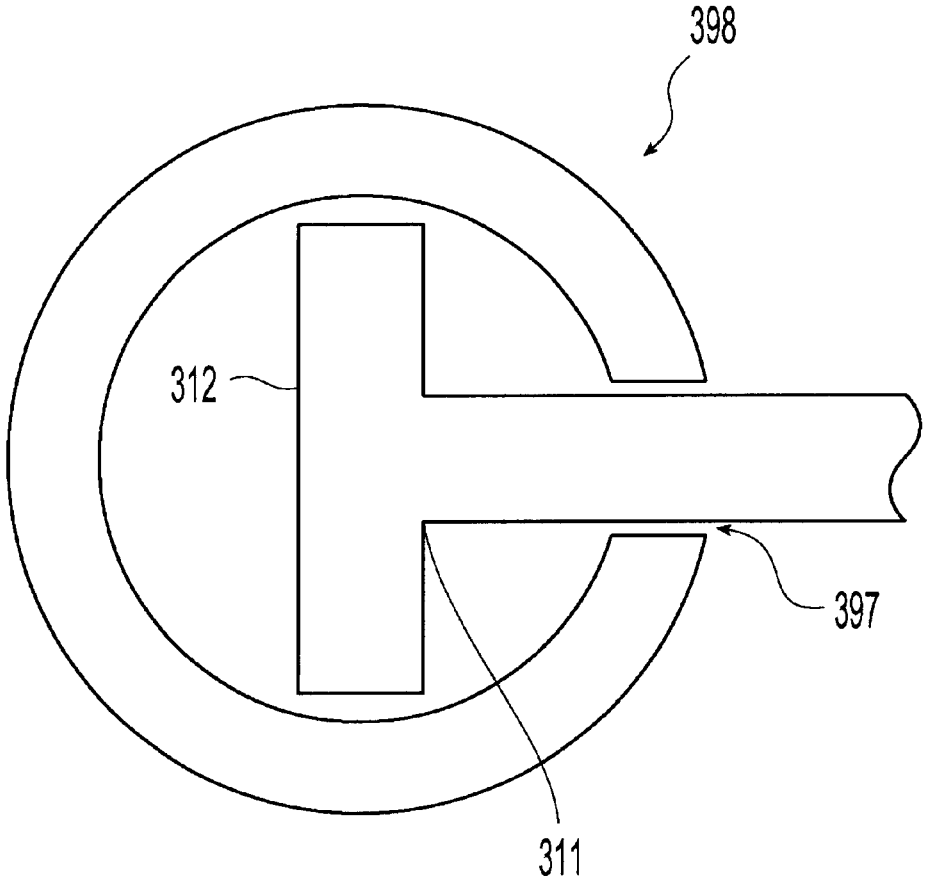
FIG. 9A is a perspective view of the bow rest of FIG. 8 mounted on a shaft with a preformed slit.

FIG. 9 illustrates a top view of bow rest 300. Bow rest 300 comprises a plate 311 having a first end section 312, a support arm 317, which contains a terminal end 318, extending downwards from the plane formed by the first end section of plate 311 towards the first end sections a second end section 313 and a intermediate section 314. Plate 311 between second end section 313 and intermediate section 314 is bent such that an angle from about 90 to about 150 degrees is formed between the plane of the first end section 312 and the plane of the second end section 313. Second end section 313 is configured to be pivotally attached to mount 315 which is configured to be fixed to a bow. First end section 312 is adapted and configured to be inserted into a preformed slit 397 of a shaft 398, as shown in FIG. 9A. Support arm 317 may be permanently attached to plate 311 and extends downwards from the plane formed by plate 311 with terminal end 318 directed towards first end section 312. Support arm 317 is adapted and configured to be inserted through the preformed slit 397 of shaft 398. When the weight of a bow is applied to bow rest 300, first end section 312 and terminal end 318 serve to hold bow rest 300 at a desired height on the hollow shaft 398.

It is understood that plate 311 may be constructed of any material displaying the necessary strength and rigidity to support the weight of a bow such as, for example, steel, aluminum, other metallic materials, composite materials, polymeric materials, wood or glass. Further, it is understood that plate 311 may be pivotally attached to mount 315 by any variety of devices and fasteners such as, for example, rivets or bolt and lock-nut combinations. Finally, it is understood that mount 315 may be of any configuration that can be fixed to a bow. Preferably, mount 315 is generally L-shaped and configured such that it may be fixed to a stabilizer hole on a bow with a bolt.

Figure 10:
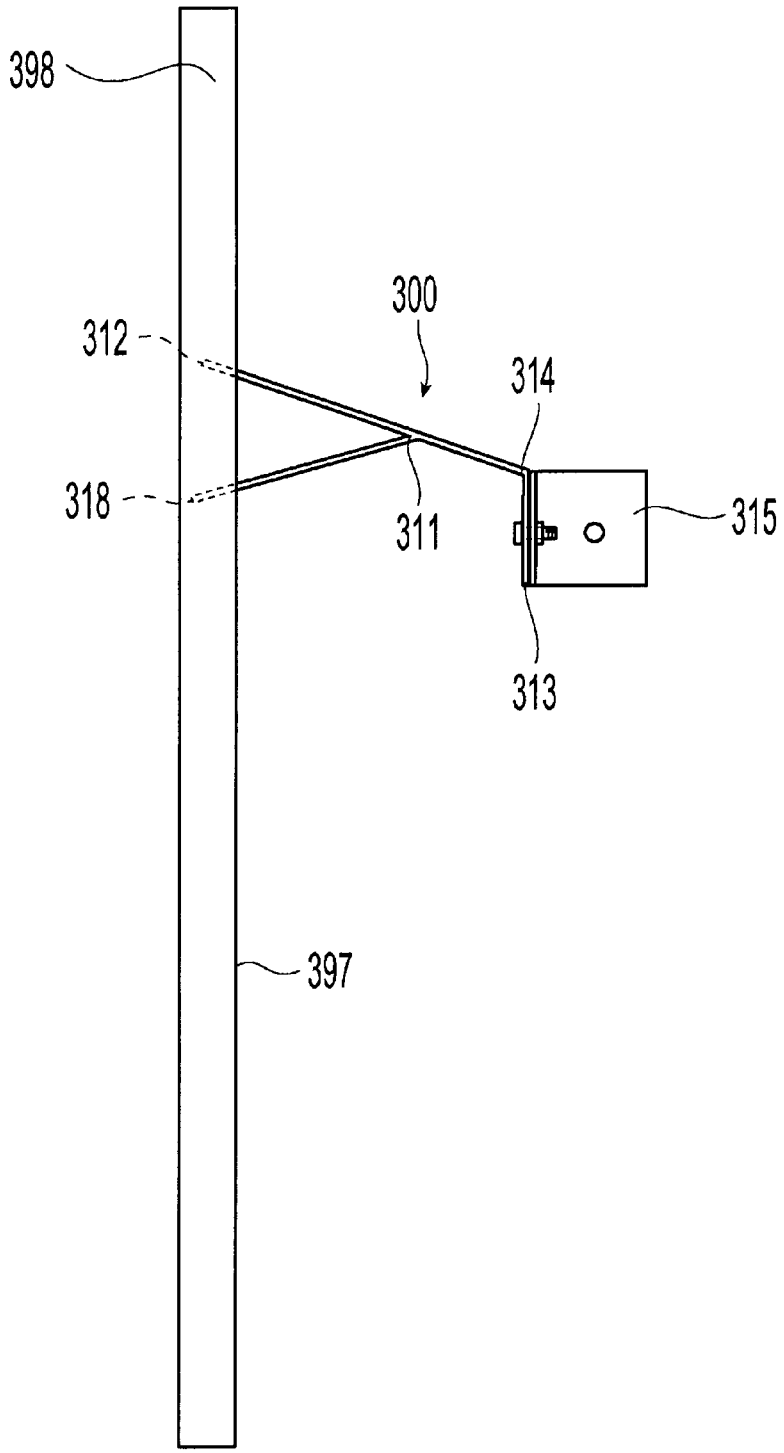
FIG. 10 is an elevation (side) view of the bow rest of FIG. 8 mounted on a shaft with a preformed slit.

FIG. 10 illustrates a side view of bow rest 300 slidably attached to hollow shaft 398, which contains preformed slit 397. Plate 311 comprising first end section 312, support arm 317, which contains a terminal end 318, second end section 313 and intermediate section 314 is pivotally attached to mount 315 with a bolt and lock-nut combination. Plate 311 is bent at intermediate section 314 such that an angle from about 90 to about 150 degrees is formed between the plane of the first end section 312 and the plane of the second end section 313. Mount 315 may be fixed to the stabilizer hole of a bow with a bolt. It is understood that the rapid and easy adjustment of bow rest 300 on hollow shaft 398, which contains preformed slit 397, would allow a sportsman to assume the most comfortable and convenient posture as dictated by the terrain or hunting situation. First end section 312 is adapted and configured to be inserted into shaft 398, which contains preformed slit 397. Support arm 317 is adapted and configured to be inserted into shaft 398, which contains preformed slit 397, such that first end section 312 and terminal end 318 slidably attach bow rest 300 to shaft 398 thereby supporting the weight of a bow attached to bow rest 300 at a desired height on shaft 398 above a surface.

Figure 11:
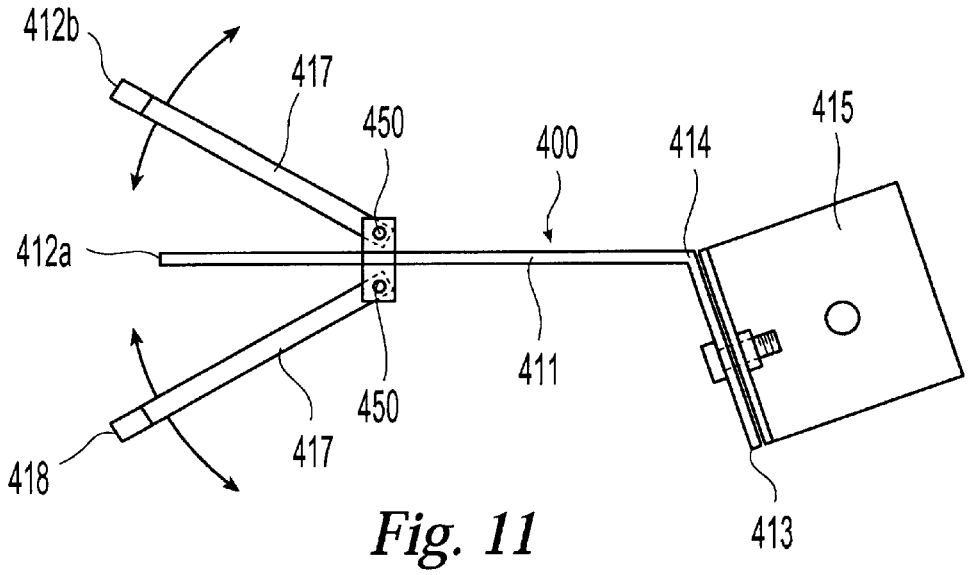
FIG. 11 is an elevation (side view) of a bow rest according to a further embodiment which incorporates two support arms.

FIG. 11 illustrates a side view of bow rest 400. Bow rest 400 comprises a plate 411 having a first end section 412*a*, two support arms 417, one of which contains a terminal end 418 and the other contains a first end section 412*b*, a second end section 413 and a intermediate section 414. Plate 411 is bent at intermediate section 414 such that an angle from about 90 to about 150 degrees is formed between the plane of the first end section 412*a* and the plane of the second end section 413. Second end section 413 is configured to be pivotally attached to mount 415 which is configured to be fixed to a bow. Support arms 417 are hingedly attached to plate 411 such that they may be positioned to lie along plate 411 towards second end section 413 or positioned to extend towards first end section 412*a*.

While plate 411 and mount 415 are illustrated as being pivotally attached with a bolt and lock-nut combination it is understood that they may be pivotally attached by any variety of devices and fasteners. Additionally, while mount 415 is illustrated as being configured to be fixed to the stabilizer hole of a bow it is understood that mount 415 may be fixed to a bow with any variety of devices and fasteners.

Figure 12:
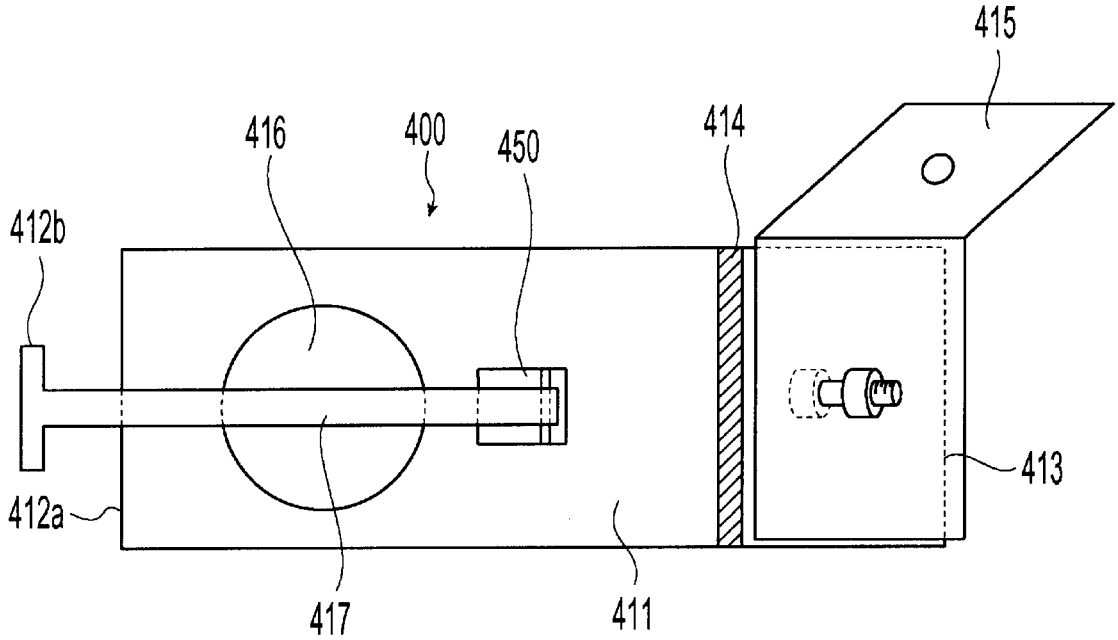
FIG. 12 is a perspective view of the bow rest of FIG. 11.

FIG. 12 illustrates a top view of bow rest 400. Bow rest 400 comprises a plate 411 having a first end section 412*a*, two support arms 417, one of which contains a terminal end (not visible in this view) and the other contains a first end section 412*b* hingedly attached to plate 411, a second end section 413 and a intermediate section 414. Plate 411 is bent at intermediate section 414 such that an angle from about 90 to about 150 degrees is formed between the plane of the first end section 412*a* and the plane of the second end section 413. Second end section 413 is configured to be pivotally attached to mount 415 which is configured to be fixed to a bow. First end section 412*b* is adapted and configured to be inserted into a preformed slit of a shaft. Support arm 417, which contains the terminal end, extends downwards from the plane formed by plate 411. Support arm 417, which contains the terminal end, is adapted and configured to be inserted through the preformed slit of a shaft. When the weight of a bow is applied to bow rest 400, first end section 412*b* and the terminal end serve to hold bow rest 400 at a desired height on the shaft.

Additionally, plate 411 contains opening 416 between intermediate section 414 and first end section 412*a*. Opening 416 is configured in shape and size such that a shaft may be inserted into opening 416 whenever support arms 417 are folded against plate 411 in the direction of second end section 413. While opening 416 is illustrated as being generally circular in shape, it may be appreciated that opening 416 may be of any shape and size desired such that a shaft may be inserted into opening 416. Further, it is understood that plate 411 may be constructed of any material displaying the necessary strength and rigidity to support the weight of a bow such as, for example, steel, aluminum, other metallic materials, composite materials, polymeric materials, wood or glass. Further, it is understood that plate 411 may be pivotally attached to mount 415 by any variety of devices and fasteners such as, for example, rivets or bolt and lock-nut combinations. Finally, it is understood that mount 415 may be of any configuration that can be fixed to a bow. Preferably, mount 415 is generally L-shaped and configured such that it may be fixed to a stabilizer hole on a bow with a bolt.

Although the present invention has been described with particular reference to the above embodiments, it should be understood that many variations and modifications will be obvious to those skilled in the art, and it should, therefore be understood that the scope of the invention is not limited by or to the specific disclosure herein, but includes all subject matter encompassed by the following claims and all equivalents thereof.

What is claimed is:

1. A bow rest, comprising:

a plate containing a first end section, a second end section, and an opening in the first end section through which a shaft may be inserted, wherein the plane of the second end section of the plate is angled with respect to the plane of the first end section such that an angle from about 90° to about 150° exists; and a mount pivotally attached to the second end section of the plate.

2. The bow rest according to claim 1, wherein the opening is generally circular in shape.

3. The bow rest according to claim 2, wherein teeth are located around at least a portion of the opening.

4. The bow rest according to claim 2, wherein a portion of the opening is covered by at least one flexible gripping aid.

5. The bow rest according to claim 4, wherein the at least one flexible gripping aid contains a slit.

6. The bow rest according to claim 1, wherein the mount is pivotally attached to the second end section of the plate with a rivet.

7. The bow rest according to claim 1, wherein the mount is pivotally attached to the second end section of the plate with a bolt and lock-nut combination.

8. The bow rest according to claim 1, wherein the mount is configured to be fixed to a stabilizer hole of a bow.

9. The bow rest according to claim 1, further comprising a mounting bracket such that the shaft may be fixed to a surface.

10. The bow rest according to claim 9, wherein the mounting bracket, comprises:

a first pressure plate, connectively attached to a second pressure plate with a tightener; and a receptacle permanently attached to the first pressure plate, which forms a generally cylindrical cavity perpendicular to the first pressure plate.

11. The bow rest according to claim 10, wherein the tightener is a nut and bolt.

12. A The bow rest according to claim 1, wherein the mount is configured to be fixed to a bow by means of a clamp.

13. A method for improving the accuracy of a sportsman, comprising the following steps:

providing a bow rest, comprising:

a plate containing a first end section and a second end section, wherein the second end section of the plate is bent such that an angle from about 90° to about 150° is formed between the plane formed by the first end section of the plate and the plane formed by the second end section of the plate, wherein an opening is formed in the plate near the first end section through which a shaft may be inserted; and a mount configured to be fixed to a bow pivotally attached to the second end section of the plate;

attaching the mount of the bow rest to a bow;

providing a shaft containing a first end and a second end;

inserting the first end of the shaft through the opening in the bow rest;

placing the second end of the shaft upon a surface; and adjusting the position of the bow rest on the shaft to the desired height.

14. The method according to claim 13, wherein the opening is generally circular in shape.

15. The method according to claim 14, wherein teeth are located around at least a portion of the opening.

16. The method according to claim 14, wherein a portion of the opening is covered by at least one flexible gripping aid.

17. The method according to claim 16, wherein the at least one flexible gripping aid contains a slit.

18. The method according to claim 13, wherein the mount is pivotally attached to the second end section of the plate with a rivet.

19. The method according to claim 13, wherein the mount is pivotally attached to the second end section of the plate with a bolt and lock-nut combination.

20. The method according to claim 13, wherein the mount is configured to be fixed to a stabilizer hole of a bow.

21. The method according to claim 13, further comprising a mounting bracket such that the shaft may be fixed to a surface.

22. The method according to claim 21, wherein the mounting bracket, comprises:

a first pressure plate, connectively attached to a second pressure plate with a tightener; and a receptacle permanently attached to the first pressure plate, which forms a generally cylindrical cavity perpendicular to the first pressure plate.

23. The method according to claim 22, wherein the tightener is a nut and bolt.

24. A bow rest, comprising:

a plate containing a first end section, a second end section and an intermediate section, wherein the second end section of the plate is bent at the intermediate section such that an angle from about 90° to about 150° exists between the plane formed by the first end section and the plane formed by the second end section of the plate;

a support arm, which contains a terminal end, attached to the plate at a point between the intermediate section and the first end section, wherein the support arm is angled downwards from the plane formed by the first end section of the plane with the terminal end extending towards the first end section of the plate; and a mount configured to be fixed to a bow pivotally attached to the second end section of the plate, wherein the first end section of the plate and terminal end of the support arm are adapted and configured to be inserted into a shaft, which contains a preformed slit, to maintain the bow rest at a desired location on the shaft.

25. The bow rest according to claim 24, wherein the mount is pivotally attached to the second end section of the plate with a rivet.

26. The bow rest according to claim 24, wherein the mount is pivotally attached to the second end section of the plate with a bolt and lock-nut combination.

27. The bow rest according to claim 24, wherein the mount is configured to be fixed to a stabilizer hole of a bow.

28. A bow rest, comprising;

a plate containing a first end section defining a first plane, a second end section defining a second plane, and an opening in the first end section through which a shaft may be inserted, wherein the second plane forms an angle with the first plane; and a mount pivotally attached to the second end section of the plate, wherein the mount is configured to be attached to a bow.

29. The bow rest according to claim 28, wherein the mount is configured to be fixed to a stabilizer hole of a bow.

30. The bow rest according to claim 28, wherein the mount is configured to be fixed to a bow by means of a clamp.

31. A method of providing a supported bow for a sportsman, comprising the following steps:

providing a bow rest, comprising:

a plate containing a first end section, a second end section, and a bent intermediate section, wherein an angle exists between the plane formed by the first end section of the plate and the plane formed by the second end section of the plate, wherein an opening is formed in the plate near the first end section through which a shaft may be inserted; and a mount configured to be fixed to a bow, said mount being pivotally attached to the second end section of the plate;

attaching the mount of the bow rest to a bow;

providing a shaft containing a first end and a second end; and inserting the first end of the shaft through the opening in the bow rest such that the bow rest engages a portion of the shaft such that the shaft supports the weight of the bow and the bow rest.

* * * * *